United States Patent [19]

Satterwhite

[11] 4,308,796

[45] Jan. 5, 1982

[54] OFFSET LITHOGRAPHIC PRESS WITH INK METERING SYSTEM FOR BLANKET CYLINDER

[75] Inventor: William L. Satterwhite, Dallas, Tex.

[73] Assignee: S-W-H, Ltd., St. Louis, Mo.

[21] Appl. No.: 57,327

[22] Filed: Jul. 13, 1979

[51] Int. Cl.[3] ..... B41F 31/06; B41F 31/12; B41F 31/36

[52] U.S. Cl. ..... 101/143; 101/144; 101/351; 101/352; 101/217; 118/261; 118/46

[58] Field of Search ..... 101/350, 351, 352, 349, 101/363, 364, 348, 247, 206, 207, 208, 209, 210, 217, 218, 148, 142, 143, 144; 118/258, 46, 262, 263

[56] References Cited

U.S. PATENT DOCUMENTS

| | | | |
|---|---|---|---|
| 1,840,067 | 1/1932 | Walker | 101/351 |
| 2,090,361 | 8/1937 | Steinmetz | 101/351 |
| 2,333,962 | 11/1943 | Terry | 101/351 |
| 3,259,062 | 7/1966 | Dahlgren | 101/148 X |
| 3,283,707 | 11/1966 | Greubel et al. | 101/352 X |
| 3,604,350 | 9/1971 | Rosenstadt | 101/351 X |
| 3,749,011 | 7/1973 | Abendroth et al. | 101/148 |
| 3,986,452 | 10/1976 | Dahlgren | 101/148 |
| 4,130,057 | 12/1978 | List et al. | 101/148 |

OTHER PUBLICATIONS

Linder, G. J., *Nonflammable Aqueous Overcoatings Serve to Speed Ink Drying . . .*, Graphics Arts Monthly, Oct. 1977, pp. 66–69.

*Primary Examiner*—J. Reed Fisher
*Attorney, Agent, or Firm*—Thomas L. Cantrell; Joseph H. Schley; Stanley R. Moore

[57] ABSTRACT

Disclosed are improved methods and apparatus for printing, including equipment for adapting an offset press so that it may be operated flexographically, either to coat stock or print on it, without impairing the function of the press as an offset press. In addition, the equipment improves the application of two-part inks or catalyst set inks and permits simultaneous printing and coating of stock. The equipment includes a pair of rollers and an ink pan, as well as drive means for the rollers, and mounting means for bringing one of the rollers into ink transfer contact with the blanket roll of an offset press. The mounting means includes quick-release collars for easy removal of the rollers from the press when they are not needed, and for maintenance.

4 Claims, 7 Drawing Figures

OFFSET LITHOGRAPHIC PRESS WITH INK METERING SYSTEM FOR BLANKET CYLINDER

BACKGROUND OF THE INVENTION

Offset lithographic printing is a method employing a plate cylinder which carries a planographic printing plate, whose image and non-image portions are substantially coplanar, the image area being hydrophobic and the non-image area being hydrophilic. A dampening system applies aqueous solution to the non-image areas of the plate, and an inking system applies a greasy ink to the image portions. The thus coated plate is rotated into contact with a resiliently surfaced blanket cylinder, thereby transferring the ink (and dampening solution) from the plate cylinder to the blanket cylinder. Printing stock, in either sheet or web form, is fed against the blanket cylinder by an impression cylinder, and the ink (and dampening solution) is transferred to the stock, thus completing the printing operation except for any heat-drying which may be employed.

Flexographic printing represents a different approach than offset printing, and its most common applications involve printing on web stock employed in packaging, such as corrugated stock, plastic, etc. Printing plates are employed in which the image areas are raised with respect to the non-image areas, rather than being co-planar with them. There is no blanket cylinder, and the plate cylinder comes into direct contact with the stock, which is delivered against it by an impression cylinder. Ink is applied to the image areas of the plate by rollers working in an ink pan adjacent the plate cylinder.

Each of these two methods of printing has its own set of advantages and disadvantages, but as the art has developed thus far, it has not been possible to operate both methods on a single press, using whichever is most advantageous for a given job. In the art of offset printing, techniques of sheet feeding are highly developed, while, as pointed out above, web feed is normative for flexographic presses, and the advantages of flexographic printing are largely foregone in sheet-fed applications.

In the field of offset printing, development work is being done on catalyst-set inks and other two-part ink systems. One difficulty with catalytic systems is the tendency of the catalyst to back-migrate from its point of application to the plate cylinder into the ink fountain, where it causes premature setting of the ink.

In some printing applications, it is desirable to coat the stock with a varnish or other coating after the printing has been applied, instead of printing on top of stock precoated by the paper manufacturer. For such applications, printing houses have a need for equipment capable of applying a suitable over-coating to printed stock. Preferably, such equipment should be capable of applying the coating simultaneously with the printing, but in any event, it should be capable of applying the coating in a separate step.

SUMMARY OF THE INVENTION

The present invention addresses the problems and needs just outlined. In accordance with the present invention, equipment is provided for mounting on an offset press for feeding ink, ink component, coating material, or another liquid directly to the blanket roll of the press. The equipment of the invention includes an ink fountain, at least a pair of rolls mounted to work in the fountain to pick up ink therefrom, means for moving one of said rolls into and out of ink transferring contact with a blanket roll, driving means for the rolls, and means for mounting these parts on an offset press adjacent its blanket roll, and for adjusting and aligning their position with respect to the blanket roll. In its preferred form, the mounting means includes quick release collars enabling easy removal of the rolls of the invention from the press for cleaning and maintenance, and so they will be out of the way when the press is used in operations not involving their use.

As those with ordinary skill in the art know well, offset presses are and have been produced in many different sizes and configurations. The equipment of the invention is made up of standardized components which, in most instances, may be readily adapted to presses of many different configurations with little or no change in any given component.

The rolls employed in the invention may have surfaces of various kinds which are effective for picking up and transferring ink, and need not have identical surfaces. For example, one roll may be rubber coated, while the other may be etched metal. The drive system for the rolls is preferably through a motor independent of the motor driving the rolls of the press, and it is preferred that a variable speed control be provided so that the rolls of the invention may be driven at selected surface speeds with respect to the surface speed of the blanket roll. In this way an additional means of controlling the transfer of ink to the blanket roll is provided, since the relative surface speeds of the blanket and transfer rolls determine the degree of scrubbing action between the two, and the intensity of the scrubbing action influences the thickness of the ink film transferred.

The equipment of the invention, when associated with an otherwise conventional offset press, materially increases the versatility of the press, and makes possible practice of the several method aspects of the invention.

A conventional offset press, with the equipment of the invention mounted thereon, may be operated as a paper coater by placing a fully exposed photosensitive plate on the blanket roll, thereby effectively converting it to a plate cylinder positioned in the same relative position as the plate cylinder of a flexographic press, that is, working against the impression cylinder. The true plate cylinder is disengaged from the thus converted blanket roll, and may even be removed from the press if desired. (The disengagement or removal of the plate cylinder also effectively disengages the dampening and inking systems associated with that cylinder.)

The ink fountain of the equipment of the invention is then loaded with coating material, and the transfer roll is positioned to work against the blanket roll which has been converted to a plate cylinder, at a selected relative surface speed. The blanket roll is placed in rotation, and stock to be coated (in either sheet or web form, depending on the press) is fed against the rotating blanket roll by the impression cylinder. Coating material is thus fed from the fountain to the transfer roll, from that roll to the plate on the blanket roll, and then from that plate to the stock.

The equipment of the invention is especially well adapted for applying water base acrylic or polyurethane coating materials, which are safer and more desirable environmentally in the press room, and which make possible water clean-up, thus saving on petroleum based solvents.

The fully exposed photosensitive plate which was used to convert the blanket roll to a plate cylinder may be replaced by a flexographic plate having raised image areas, and the coating material in the fountain of the equipment of the invention replaced with a flexographic type ink. The offset press in this condition is thereby made capable of printing flexographically when circumstances make it desirable to use this printing technique, with a far smaller capital investment than would be necessary to obtain a separate flexographic press.

When it is desired to operate the press as a conventional offset press, the coating plate or flexographic plate on the blanket roll is removed, and the transfer roll is moved out of working engagement with the blanket roll. If desired the transfer roll and pick-up roll may be removed from the press entirely. The plate cylinder is brought back into engagement with the blanket roll, and the press is thereby placed in condition to operate in the conventional offset manner.

When it is desired to conduct offset printing utilizing a catalyst set ink, the press is set up in the conventional offset manner, but with the transfer roll of the equipment of the invention positioned to work against the blanket roll. The primary ink component is placed in the main ink fountain feeding ink to the plate cylinder. The catalyst bearing component is placed on the blanket roll by the transfer roll prior in time to the transfer of the primary ink component from the image areas of the plate cylinder to the blanket roll. The thus catalysed ink on the blanket roll is then transferred to the stock brought against the blanket roll by the impression cylinder.

Several important advantages are obtained in accordance with this aspect of the invention. The ink is catalysed on the blanket roll immediately prior to its transfer to the stock, instead of at some point up on the plate cylinder. This means that extremely quick setting inks may be employed, and the danger of the ink setting prematurely on the plate cylinder is substantially eliminated. Furthermore, since the catalyst component of the ink, and its point of application, are farther removed from the main ink fountain, the danger of significant back-migration of the catalyst component up into the main ink fountain is greatly reduced, if not completely eliminated.

Another advantage flowing from the use of catalyst-set ink is that the need for spraying anti-offset powder onto the freshly printed stock to prevent the sheets from sticking together is eliminated, thus improving the press room environment and making it safer.

When it is desired to coat stock simultaneously with the printing of it, the press is set up in conventional offset manner, except that coating material (and lithographic plate desensitizing material, such as phosphoric acid and gum arabic) is placed in the fountain of the equipment of the invention, and the transfer roll is positioned to work against the blanket roll. In accordance with this aspect of the invention, a layer of coating material is first placed on the blanket roll. Ink is then placed on top of it by the plate cylinder. When the blanket roll contacts the stock, the ink is transferred to the stock, with the coating material being transferred to the stock primarily on top of the ink, as well as over the non-image areas. In such operations careful attention must be given to balancing aqueous and oily materials both in the ink and varnish in accordance with good practice in the art.

From the foregoing it can also be seen that catalyst may be incorporated into the coating material, and a catalyst set ink employed in the simultaneous printing and coating operation.

From the foregoing, it can be seen that a major object of the present invention is to greatly increase the capabilities of offset presses by adding to them a relatively simple and inexpensive set of equipment.

In particular, it is an object of the invention to equip an offset press so that it may print in a flexographic mode when desired and yet be readily returnable to operation in the standard offset mode.

In addition, it is an object of the invention to equip an offset press so that is is capable of operation as a paper coater, coating over printing either simultaneously with the printing, or in a separate step.

Another object of the invention is to equip an offset press to better handle two part or catalyst set inks.

Still another object of the invention is to equip an offset press to simultaneously print with catalyst set ink and coat the stock over the printing.

In addition, it is an object of the invention to provide a set of equipment giving an offset press the above-described capabilities, which equipment is made up of standardized components readily adaptable to presses of many different sizes and configurations.

The manner in which the foregoing objects and purposes, together with other objects and purposes, are achieved can best be understood from a consideration of the detailed description which follows, together with the accompanying drawings.

DESCRIPTION OF THE PREFERRED EMBODIMENTS

Figure 1:
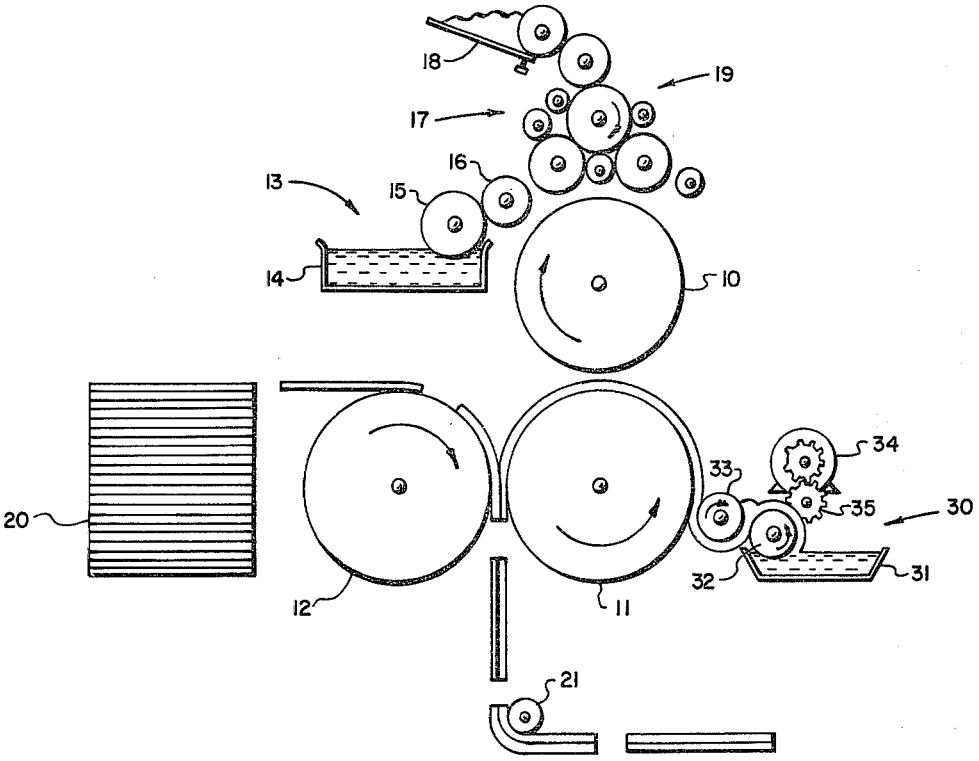
FIG. 1 is a very diagrammatic side elevational view, with many standard structural parts omitted for the sake of clarity, of an offset press to which has been applied the equipment of the invention.

Attention is first directed to FIG. 1, which shows a conventional offset press in very diagrammatic form. The primary components of the press which are of present interest are the plate cylinder 10, blanket cylinder 11, and impression cylinder 12. Mounted adjacent the plate cylinder is a dampening system 13, including a dampening fountain 14, a metering roll 15, and a dampening roll 16. Also mounted adjacent the plate cylinder is an inking system 17, including a paste ink fountain 18 and a set of metering and transfer rolls 19. Various systems of metering and transfer rolls are in common use, and the roll set 19 in FIG. 1 is intended to be merely illustrative. A supply of printing stock 20 (shown as stacked sheets, but it may be a roll of web stock) is positioned to be fed, by conventional feeding means not shown in FIG. 1 to the impression cylinder 12.

The press as just described is conventional. In its conventional operation, a planographic plate is mounted in plate cylinder 10, which rotates clockwise as FIG. 1 is drawn. Aqueous dampening solution is applied to the hydrophilic non-image portions of the plate by the dampening system 13 as the plate is rotated past dampening roll 16. Greasy ink from fountain 18 is applied to the hydrophilic image portions of the plate by metering and transfer roll set 19. As the inked and dampened portion of the plate is further rotated, it comes into contact with the resilient surface of the blanket roll 11, which rotates counter-clockwise as FIG. 1 is drawn. The ink and dampening solution are transferred by this contact to the surface of the blanket roll.

Printing stock is fed from supply 20 onto clockwise rotating impression cylinder 12, which carries it through the nip between blanket cylinder 11 and impression cylinder 12. As the stock passes through this nip, the ink and dampening solution are transferred from the blanket cylinder to the stock, which is led away from the press by a take-off roll 21.

Conventionally, means are provided on an offset press such as that shown in FIG. 1 for moving the plate cylinder out of contact with the blanket cylinder for set-up, cleanup and maintenance purposes, and provision is also made for removing various rolls and cylinders from the press.

In FIG. 1, the equipment of the invention is shown as applied to the conventional offset press just described. It is designated generally as 30, and the components thereof appearing diagrammatically in FIG. 1 are ink fountain pan 31, metering roll 32, transfer roll 33, variable speed drive motor 34, and drive train 35. Drive motor 34 is preferably provided with a speed control so that the relative surface speeds of transfer roll 33 and blanket roll 11 may be established at desired values. A single metering roll 32 is shown in FIG. 1, but those skilled in the art will understand that multiple roll metering systems may be employed without departing from the scope of the invention.

The equipment of the invention 30 is shown in FIG. 1 as mounted on the offset press so that transfer roll 33 is in contact with blanket cylinder 11, and metering roll 32 is disposed in fountain 31 and in contact with transfer roll 33. The mounting means by which this is accomplished are not shown in FIG. 1 for the sake of simplicity, but are shown in full detail in FIGS. 2 through 5, to which attention is now directed.

In the case of a number of widely used offset presses the frame or other stationary portion of the press includes a substantial horizontal surface running the length of the blanket cylinder. This surface is designated 36 in FIG. 2, and it is exploited as a mounting surface in the practice of the invention. If no such surface exists on a particular press to which the invention is to be applied, a shelf may be added to the press frame to provide one, the geometry of the shelf depending on the geometry of the press frame. Similarly, on many presses, the frame includes a pair of convenient vertical surfaces located above surface 36 at either end of the blanket roll, one of which appears in FIG. 2 where it is designated 37. These, too, are exploited as mounting surfaces in the practice of the invention. Again, if such surfaces are absent from a particular press, they may be added.

The mounting means of the invention includes main mounting plate 38, which slidingly rests on surface 36, and two side mounting plates 39, one attached at either end of plate 38 to press frame surface 37. As can best be seen in FIG. 5, plate 39 has a cut-out 40 in the bottom thereof, while the end of plate 38 has a tongue 41 formed on it. Tongue 41 is narrower than cut-out 40, so that when tongues 41 are fitted into cut-outs 40 at each side of the press, there is room for mounting plate 38 to be slid on surface 36 toward and away from the blanket roll.

In accordance with the invention, control of the position of mounting plate 38 (and of the equipment mounted on it) with respect to the blanket cylinder is provided by adjusting screw 42 which runs in clearance holes 43 and 44 in plate 39 and clearance hole 45 in tongue 41. Adjusting screw 42 is secured to plate 39 by set nuts 46 and 47, and locked against rotation when adjustment is completed by lock collars 48 and 49. Clearance hole 45 in tongue 41 has threaded inserts 50, 51, mounted in either end thereof, and screw 42 is threaded through them. Thus, when adjusting screw 42 is rotated it will push plate 38 toward the blanket cylinder or pull it away from the cylinder, depending upon the direction of rotation of the screw. By turning and then locking the adjusting screws at either end of plate 38, the plate may be brought to the desired position with respect to the blanket roll and held there.

Figure 2:
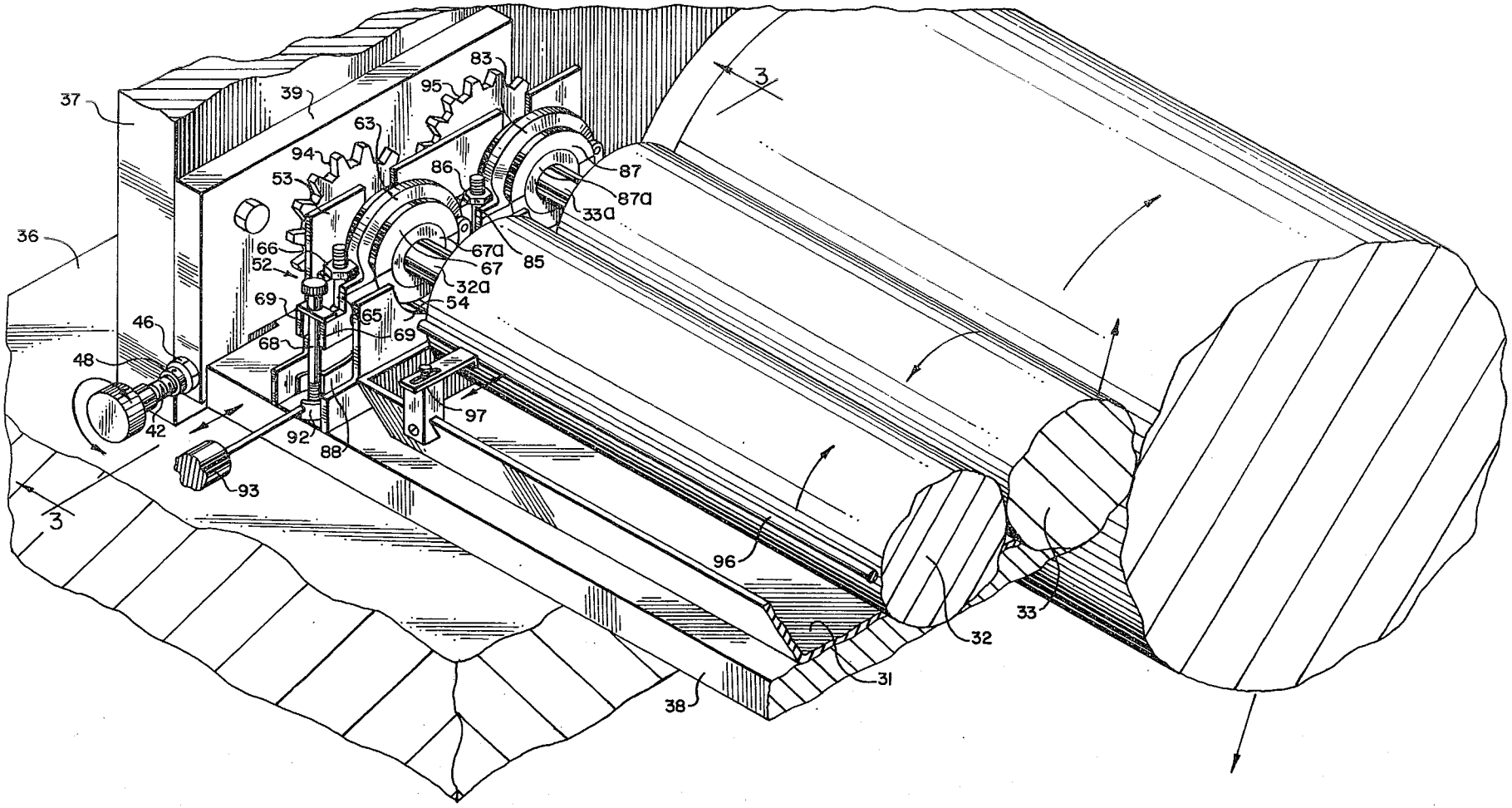
FIG. 2 is a fragmentary perspective view on an enlarged scale of one embodiment of the equipment of the invention, showing also a portion of an offset press on which it is mounted.

As appears best in FIG. 2, ink fountain 31 is positioned on main mounting plate 38, as are the roll mounting means designated generally as 52.

Figure 3:
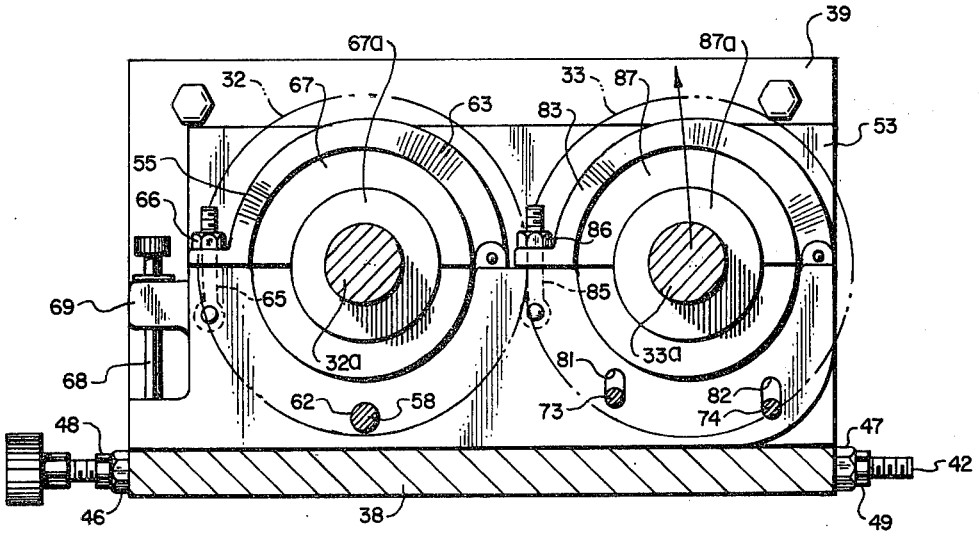
FIG. 3 is a sectional side elevational view of the mounting means for the metering roll and transfer roll employed in the embodiment of FIG. 2, the section being taken on line 3—3 of FIG. 2.
Figure 4:
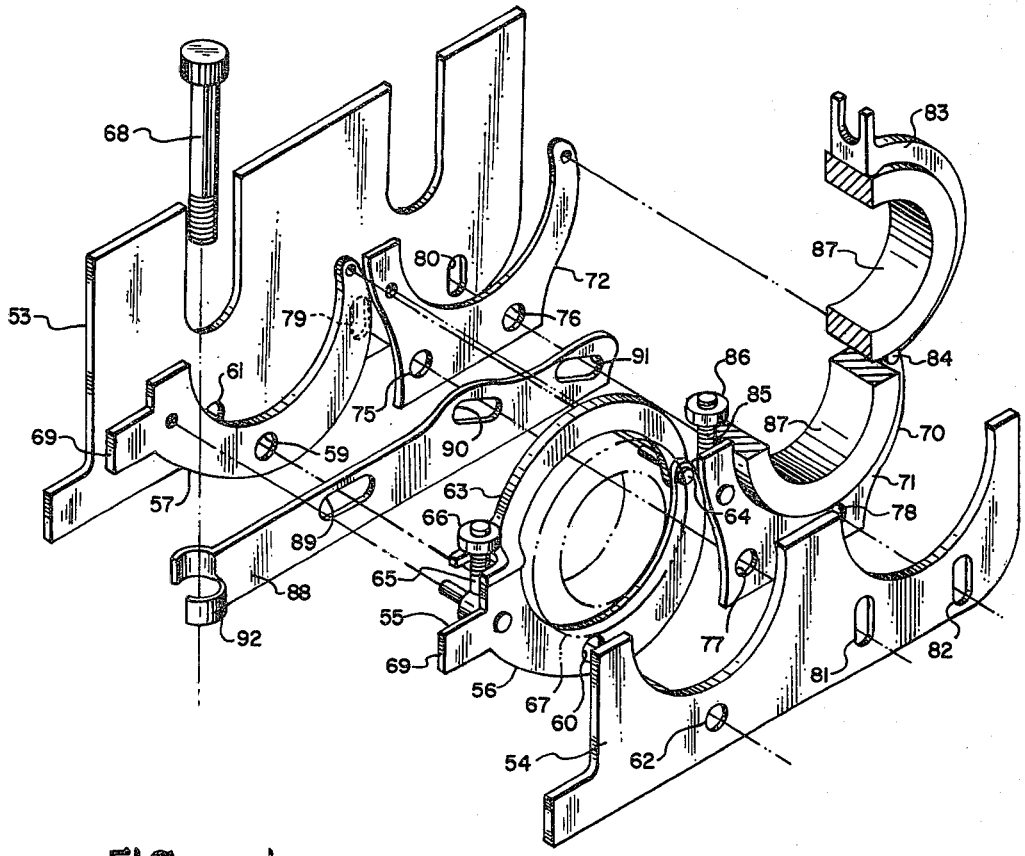
FIG. 4 is an exploded perspective view of a portion of the mounting means of FIG. 3.

The structure of roll mounting means 52 may best be understood by a consideration of FIGS. 2–4. In the embodiment shown in those Figures, the roll mounting means comprise a pair of vertically oriented base plates 53, 54 which are positioned parallel to each other on mounting plate 38, one pair being positioned at each end of fountain pan 31. Mounted between the base plates and carried by them are two collars which support the shafts of metering roll 32 and transfer roll 33, these shafts being designated **32*a* and 33*a***, respectively.

Metering roll collar 55 is made up of a pair of bottom yokes 56, 57 which are pivotally mounted on the vertical bases 53, 54 by pin 58, which passes through holes 59, 60 in the bottom yokes and is fixed in holes 61, 62 of vertical base plates 53, 54. The metering roll collar also includes a top yoke 63, one side of which is pivotally attached to the bottom yokes by pin 64, and the other side of which is detachably connected to the bottom yokes by swing bolt 65 and nut 66. Mounted in the yokes of the metering roll collar is a split bushing 67, which engages the housing of anti-friction bearing **67*a* carried on shaft 32*a*. From the foregoing, it can be seen that metering roll 32 can easily be removed from collar 55 by merely loosening nut 66, and swinging top yoke 63 to open the collar. Remounting roll 32** is similarly easily accomplished.

Metering yoke collar 55 and metering roll 32 may be pivoted toward and away from transfer roll 33, the pivoting taking place around 58. The degree of pivoting is controlled by bolt 68, which works in a threaded hole in main mounting plate 38, and which engages wings 69 on bottom yokes 56, 57. In this manner provision is made for controlling the pressure with which the metering roll and transfer roll contact each other, and this pressure in turn is one means of controlling the rate at which liquid is fed from the fountain pan to the blanket roll.

Transfer roll collar 70 is also made up of a pair of bottom yokes 71, 72, which are slidingly mounted on vertical base plates 53, 54 by pins 73, 74 which pass through holes 75, 76, 77, 78 in the bottom yoke and work in slots 79, 80, 81, 82 in vertical base plates 53, 54. The transfer roll collar further includes a top yoke 83, which is pivoted to the bottom yokes on one side by pin 84, and detachably connected to them on the other side by swing bolt 85 and nut 86. Within the yokes is mounted a split bushing 87, which in turn engages anti-friction bearing 87*a* carried on shaft 33*a*. This arrangement facilitates installation and removal of transfer roll 33.

An actuating bar 88 is provided for moving transfer roll collar 70, and transfer roll 33 into and out of contact with the blanket roll. In the embodiment of FIGS. 2–5, the direction of this movement is substantially vertical, but in other embodiments designed to fit a particular press it may be at an angle or even horizontal. Actuating bar 88 has a slot 89 therein to clear pin 58 and cam slots 90, 91, therein positioned to work against pins 73, 74 of the transfer collar to lift the transfer roll when the actuating bar is moved to the right as FIGS. 3 and 4 are drawn. The end of bar 88 is curved as at 92 to avoid interference with bolt 68. A solenoid or air-operated piston and cylinder 93 (see FIG. 2) is provided for power operation of the actuating bar.

From the foregoing discussion of the mounting means of the invention as shown in the embodiment of FIGS. 2–5, it can be seen that the following capabilities are provided: (1) the position of the transfer roll with respect to the blanket roll may be adjusted without altering its position with respect to the metering roll and ink fountain, since these parts move with it on the movable main mounting plate; (2) the contact pressure between the metering roll and the transfer roll can be adjusted by pivoting the metering roll; (3) the transfer roll can be moved into and out of contact with the blanket roll; and (4) both the metering roll and the transfer roll can be easily removed for cleanup and maintenance, or merely to get them out of the way when they are not needed.

Referring again to FIG. 2, it can there be seen that roll shafts 32*a* and 33*a* have drive gears 94, 95 mounted thereon adjacent their ends. Alternately, these gears may be mounted inboard of bearings 67*a* and 87*a*, but they have been shown as drawn in FIG. 2 for clarity in presentation. Gears 94, and 95 are driven by other gears of the drive train (represented diagrammatically at 35 in FIG. 1) and ultimately by drive motor 34 (FIG. 1).

An additional means for exercising control over the flow rate of liquid between the fountain pan and the transfer roll is provided by metering bar 96, which is adjustably mounted on the ink fountain by mounting bracket 97 so that it lies closely adjacent the surface of metering roll 32. In this way the thickness of the layer of liquid carried on the surface of the metering roll to the nip between it and the transfer roll may be controlled by adjusting the spacing between the bar and the roll.

Figure 5:
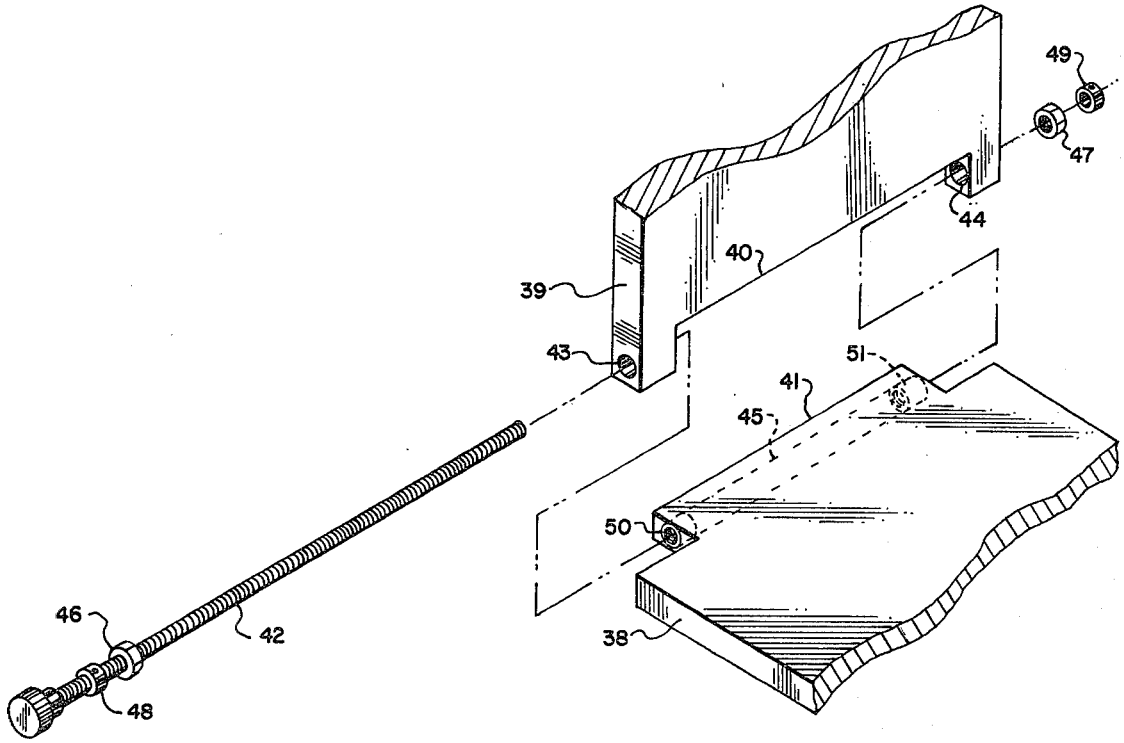
FIG. 5 is an exploded perspective view of another portion of the mounting means of FIG. 3.
Figure 6:
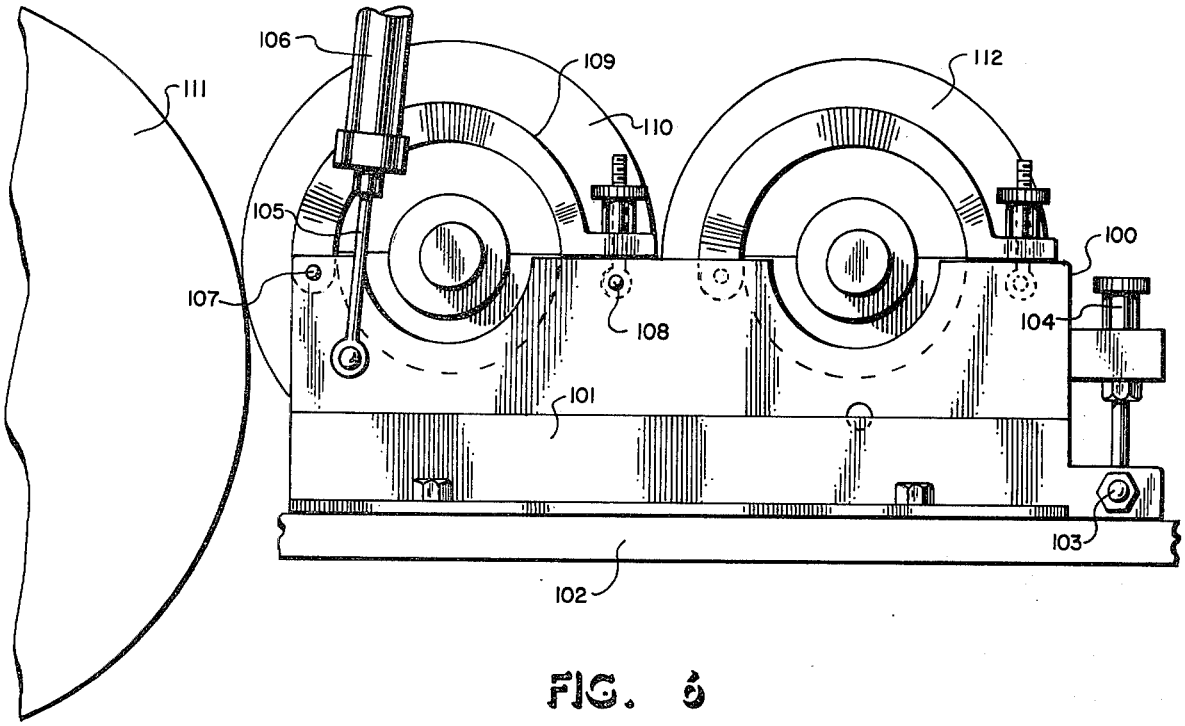
FIG. 6 is an end elevational view of another embodiment of mounting means for the metering and transfer rolls of the invention, showing the transfer roll in contact with an offset press blanket cylinder.
Figure 7:
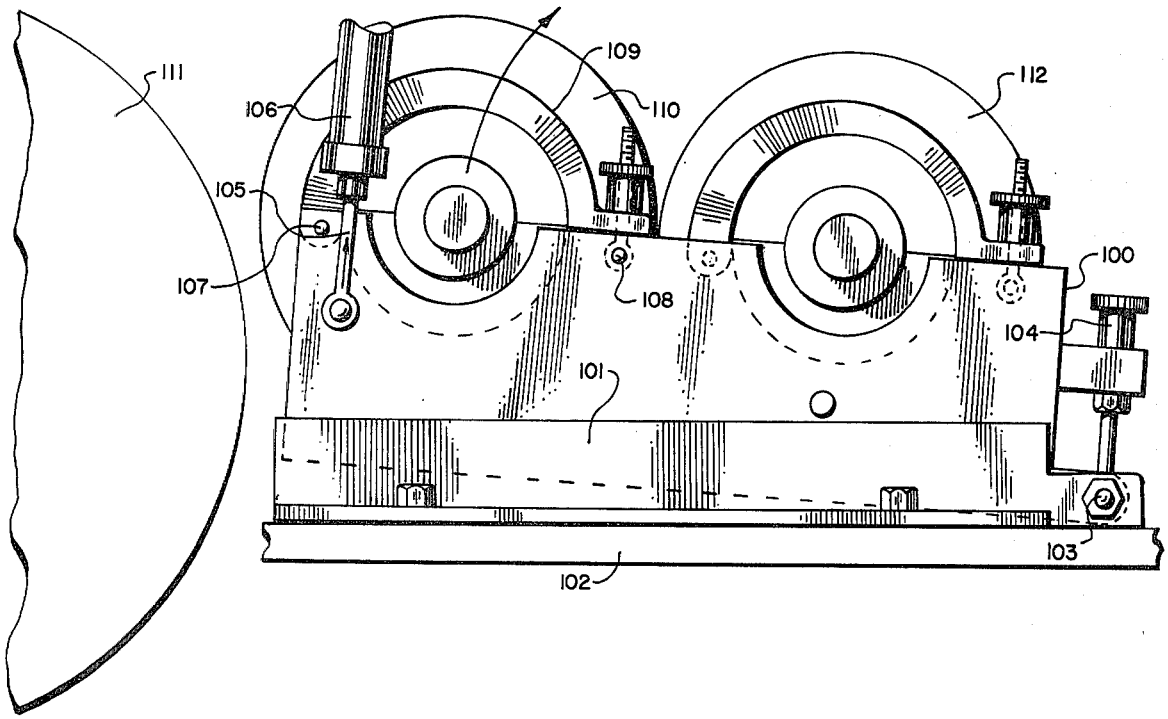
FIG. 7 is an end elevational view similar to FIG. 6, showing the metering roll moved out of contact with the blanket cylinder.

Attention is now directed to FIGS. 6 and 7, which show an alternate embodiment of the roll mounting means of the invention, which is especially useful on those presses whose structure is such that it is more convenient to move the transfer roll into and out of contact with the blanket cylinder by an actuator which is generally vertically mounted rather than by a horizontal actuator such as that employed in the embodiment of FIGS. 2–5. Many of the parts are similar or substantially the same as those discussed in connection with that embodiment, and reference is made to the above discussion for a detailed understanding of those parts.

In the embodiment of FIGS. 6 and 7, the vertical base plates 100 are pivotally mounted between a pair of vertical support plates 101, which are in turn bolted to main support plate 102. The pivot point is at bolt 103, which also serves to anchor metering roll adjusting screw 104 by passing through an eye formed in the end thereof.

The horizontal actuating bar 88 of the FIGS. 2–5 embodiment is omitted, and is replaced by actuating rod 105, which may be the piston rod of air-operated piston and cylinder unit 106. Pins 107, 108, connect transfer roll collar 109 to vertical base plates 100 so that when actuating rod 105 pivots plates 100 about bolt 103, the collar 109, as well as transfer roll 110, is pivoted toward or away from blanket cylinder 111, while maintaining its position with respect to the adjusted position of metering roll 112.

With the foregoing description of the equipment of the invention in hand, its mode of operation, and the mode of operation of an offset press equipped with it, can be described with primary reference to FIG. 1.

The equipment of the invention 30 is first positioned so that the transfer roll 33 establishes satisfactory contact with the blanket cylinder 11 (when it is actuated into its contact position) by adjusting the portion of the mounting means illustrated in FIG. 5, and the metering roll pressure against the transfer roll is adjusted to a satisfactory level by pivoting its mounting collar.

As FIG. 1 is drawn, the thickness of the printing stock and the thickness of the layer of ink or coating material on rolls 32 and 33 and blanket cylinder 34 are both greatly exaggerated for clarity of illustration.

FIG. 1, as drawn, shows the press and the equipment of the invention set up and operating as a paper coater. Plate cylinder 10, including its dampener 13 and inking system 17, is spaced out of contact with blanket cylinder 11, and is inactive in this mode of operation. A fully exposed photosensitive plate is mounted on the blanket cylinder. Coating material (varnish) is placed in fountain 31. As motor 34 drives metering roll 32 and transfer roll 33, a layer of coating material is picked up from the fountain and transferred to the plate on the rotating blanket cylinder. As the rotating blanket cylinder engages sheets of paper stock (or a web of stock) presented to it by impression cylinder 12, the layer of coating material it carries is transferred to the stock, thus coating it.

If the above mentioned photosensitive plate is removed from blanket cylinder 11 and is replaced with a flexographic printing plate and if the coating material in fountain 31 is replaced by flexographic type ink, then FIG. 1, as drawn, represents the equipment of the invention operating to enable the offset press to print flexographically. Flexographic ink is transferred by rolls 32 and 33 to the image areas of the flexographic plate on blanket cylinder 11, and thence to the stock.

If the offset press is again needed for conventional offset printing, transfer roll 33 is disengaged from the blanket cylinder, and if desired, it and metering roll 32 may be completely removed from the press. The plate is removed from the blanket cylinder, and the plate cylinder is returned to engagement with the blanket cylinder, thus restoring the press to conventional offset configuration.

With the press in offset configuration, and with transfer roll 33 engaging the blanket roll, catalyst-set ink printing may be performed, with the catalyst component being placed in fountain 31. Similarly, simultaneous printing and coating, including printing with catalyst set ink may be performed.

I claim:

1. Apparatus for attachment to an offset lithographic press of the kind having a plate cylinder, a blanket cylinder, and an impression cylinder, said apparatus comprising:

an ink fountain an ink transfer roll;

an ink metering system positioned to transfer ink from said fountain to said transfer roll, said metering system including at least one metering roll;

mounting means for mounting said fountain, transfer roll and metering system on said press adjacent its blanket cylinder, said mounting means including means for adjusting the position of said transfer roll with respect to said blanket cylinder said mounting means comprising;

a main mounting plate slidingly mounted on a substantially horizontal surface of said press adjacent said blanket cylinder;

adjusting screw mounting means attached to said press adjacent each end of said main mounting plate;

an adjusting screw confined against endwise movement in its mounting means but free to rotate therein;

threaded means on said main mounting plate threadedly engaging said adjusting screw, whereby rotation of said adjusting screw slides said main mounting plate toward and away from said blanket cylinder;

said fountain being mounted on said main mounting plate; and said mounting means further comprising:

(i) vertical base plates mounted on said main mounting plate adjacent each end of said fountain; and (ii) collars mounted on said vertical plates and engaging said metering roll and said transfer roll to support them above said fountain, the upper portion of said collars being pivotable with respect to the lower portions thereof to thereby provide for rapid removal and installation of said rolls out of and into said collars;

means for adjusting the pressure between said metering roll and said transfer roll;

means for moving said transfer roll into and out of contact with said blanket cylinder including means mounting said collars engaging said transfer roll on said vertical base plates for movement with respect to said vertical base plates toward and away from said blanket cylinder; and a variable speed motor for said metering roll and said transfer roll.

2. Apparatus in accordance with claim 1 in which said adjusting screw mounting means comprise a side mounting plate mounted on said press adjacent an end of said main mounting plate, said side mounting plate having a cut-out in the bottom thereof, and in which said main mounting plate has a tongue at an end thereof narrower than said cut-out and projecting thereinto, and in which said adjusting screw passes through said side mounting plate and said tongue.

3. Apparatus in accordance with claim 1 and further comprising mounting means for each of said collars engaging said transfer roll each of said collar mounting means comprising:

a guide slot on one of said vertical base plates;

an actuating bar positioned parallel to said one vertical base plate;

a cam slot in said actuating bar; and a pin in each of said collars passing through said guide slot and said cam slot, to thereby provide for said movement of said collars toward and away from said blanket cylinder upon reciprocal movement of said actuating bar along said vertical base plate.

4. Apparatus in accordance with claim 1 in which said mounting means for said collars engaging said transfer roll comprises:

pivot means on said vertical base plates mounting both said transfer roll engaging collars and the collars for said metering roll for pivoting movement with respect to said blanket cylinder; and an actuating rod for effecting said pivotal movement.

* * * * *